US007232971B2

(12) United States Patent
Chen

(10) Patent No.: US 7,232,971 B2
(45) Date of Patent: Jun. 19, 2007

(54) CIRCUIT BREAKER

(76) Inventor: Tsan-Chi Chen, 8F, No. 120-11, Sec. 3, Chung Shan Road, Chung Ho City, Taipei Hsien (TW) 235

( * ) Notice: Subject to any disclaimer, the term of this patent is extended or adjusted under 35 U.S.C. 154(b) by 482 days.

(21) Appl. No.: 10/910,615

(22) Filed: Aug. 4, 2004

(65) Prior Publication Data

US 2006/0028317 A1 Feb. 9, 2006

(51) Int. Cl.
*H01H 5/08* (2006.01)

(52) U.S. Cl. ..... 200/460; 337/36; 337/79; 337/376; 361/93.1; 361/114; 361/115; 335/20; 200/408; 200/409; 200/308; 200/315

(58) Field of Classification Search ..... 361/114, 361/115, 93.1; 335/20; 337/36; 200/315, 200/408, 409, 460
See application file for complete search history.

(56) References Cited

U.S. PATENT DOCUMENTS 2,892,050 A * 6/1959 Fisher ..... 200/456
5,079,530 A * 1/1992 Tsuchiyama ..... 335/17
5,172,294 A * 12/1992 Ineichen et al. ..... 361/115
6,452,125 B1 * 9/2002 Yu ..... 200/553

* cited by examiner

*Primary Examiner*—Thao X. Le
*Assistant Examiner*—Christopher Geoghegan
(74) *Attorney, Agent, or Firm*—Bacon & Thomas, PLLC

(57) ABSTRACT

A circuit breaker includes a shell, a movable press strip, a metal strip, a C-shaped plate spring, and three conductors. A first and a second conductor are inserted through the bottom of the shell, respectively have an upper end extending up in the shell, with a first contact point on its upper end of the first conductor, with an upper end of the second conductor connected with a metal strip, which has one end facing under a first press member of the press strip and an elastic contact strip with one end provided with a second contact point facing under the first contact point. A C-shaped plate spring has two lower ends connected with the metal strip, and a curved-up portion facing a second press member. The contact strip may disfigure by high heat caused by excessive current, curling upward to force the first contact point snap off the second contact point to cut off the circuit breaker.

5 Claims, 4 Drawing Sheets

CIRCUIT BREAKER

BACKGROUND OF THE INVENTION

1. Field of the Invention

This invention relates to a circuit breaker, particularly to one provided with an elastic contact strip of a metal strip to disfigure by excessive heat to lift up a C-shaped plate spring, which then forces one of two contacts to snap off the other contact to automatically turn off the circuit breaker. Or a user can opt to press one or the other of two ends of an movable compress key positioned in the upper portion of a shell to cut off or reset the switch to turn on again to let current get through, depending on a practical condition.

2. Description of the Prior Art

There are many kinds of circuit breakers in use and available on the market for users to choose, for cutting off a current in case of the current becoming excessively larger than the preset load or letting a current get through after cut off, keeping safety in using electricity for avoiding dangers of fire or electrocution by accident.

One of conventional circuit breakers may have a defect that a user directly cannot choose to turn off the breaker or reset it or to let the switch to turn on to let current get through again, because of its structure.

Another of conventional circuit breakers may have a defect that a press key provided in the circuit breaker is exposed upward out of the breaker body for turning off or resetting the breaker. So the press key is liable to be pressed accidentally to reset the breaker already in the cut-off condition by excessive large current, causing the breaker to be burned up by excessively large current flowing through and causing a fire.

One more of conventional circuit breakers may have its structure composed of many complicated components to result in a large size of the circuit breaker. In addition, its cost will also be high, losing competitiveness on the market.

SUMMARY OF THE INVENTION

This invention has been devised to offer a circuit breaker improved in those defects the conventional ones have. The feature of the invention is the compactness of its structure, preventability of the compress key from accidental pressing to be cut off or reset, and feasibility of manual turning off or resetting by a user.

The circuit breaker according to the invention has a shell, a movable press strip pivotally connected with the shell by a pivot and positioned in an upper portion of the shell, two conductors, a metal strip, and a C-shaped plate spring. A first conductor has a lower end exposing out of the bottom of the shell and an upper end extending in the shell in a horizontal condition and provided with a first contact point. A second conductor has a lower end exposing out of the bottom of the shell and an upper end extending up in the shell to connect with the left end of the metal strip, which has the right end just facing under a first press member of the movable press strip. The metal strip has an elastic contact strip formed as integral with the metal strip body with the left end provided with a second contact point facing on the first contact point. Then the left end of the metal strip is connected with two lower ends of the C-shaped plate spring, which has its curved-up portion just facing under a second press member of the movable press strip. Then when the elastic contact strip is heated up and disfigures by high heat caused by excessive current surpassing the preset value for the circuit breaker in a turned-on condition, the elastic contact strip may curl up, forcing the second contact point snap off the first contact point, cutting off automatically the circuit breaker.

BRIEF DESCRIPTION OF DRAWINGS

This invention will be better understood by referring to the accompanying drawings, wherein.

DETAILED DESCRIPTION OF THE PREFERRED EMBODIMENTS

Figure 1:
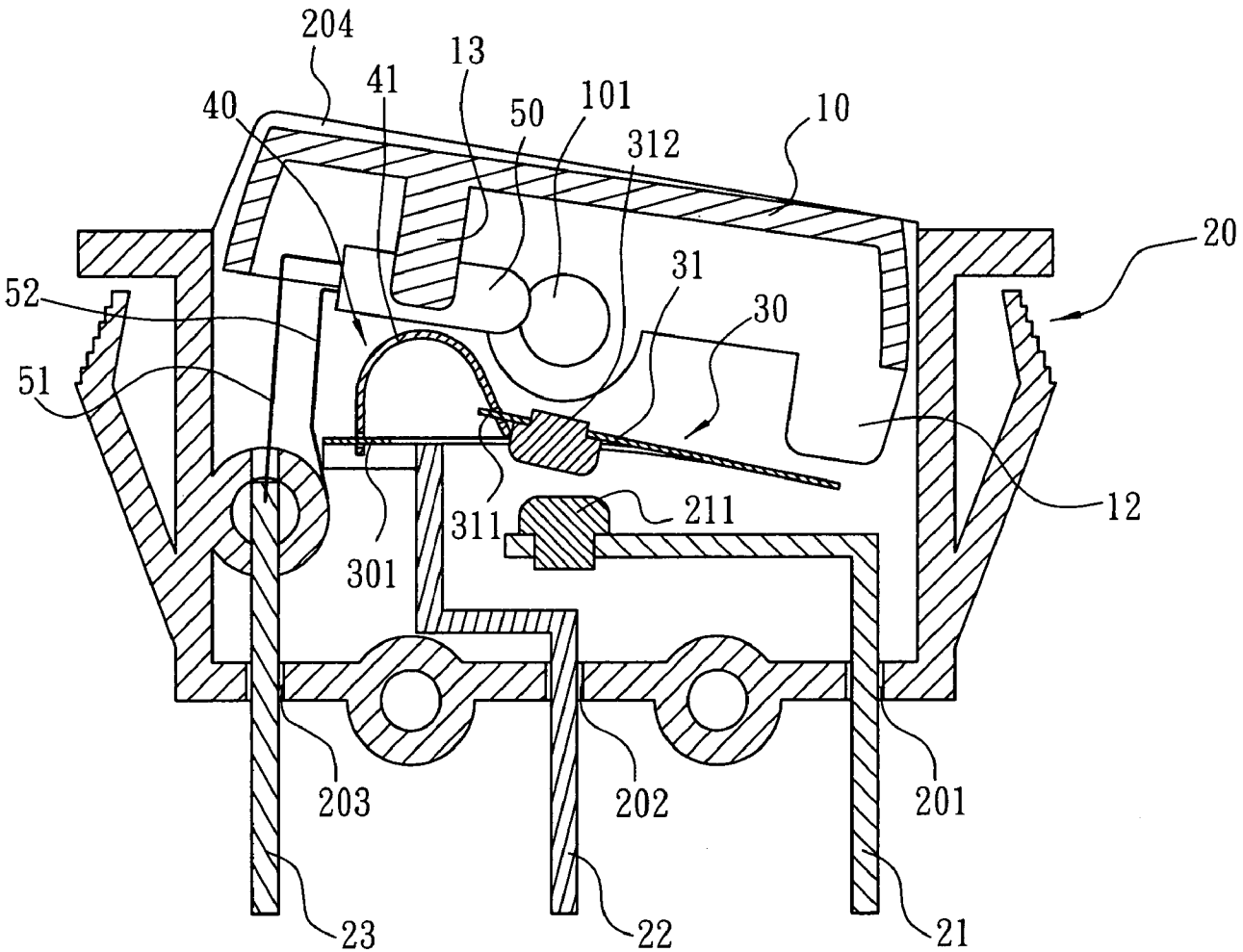
FIG. 1 is a cross-sectional view of a first embodiment of a circuit breaker in the present invention.
Figure 2:
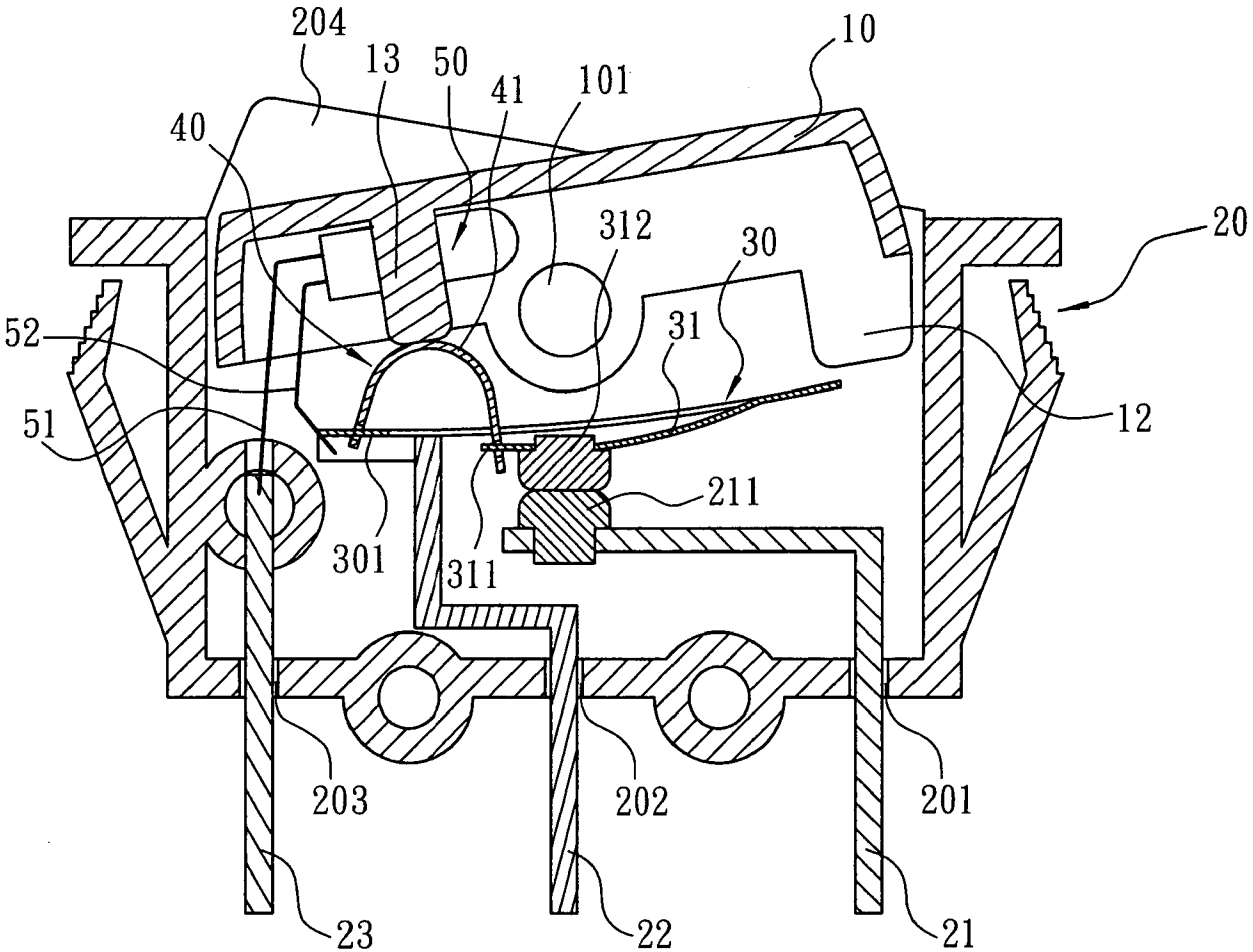
FIG. 2 is another cross-sectional view of the first embodiment of a circuit breaker in the present invention.
Figure 3:
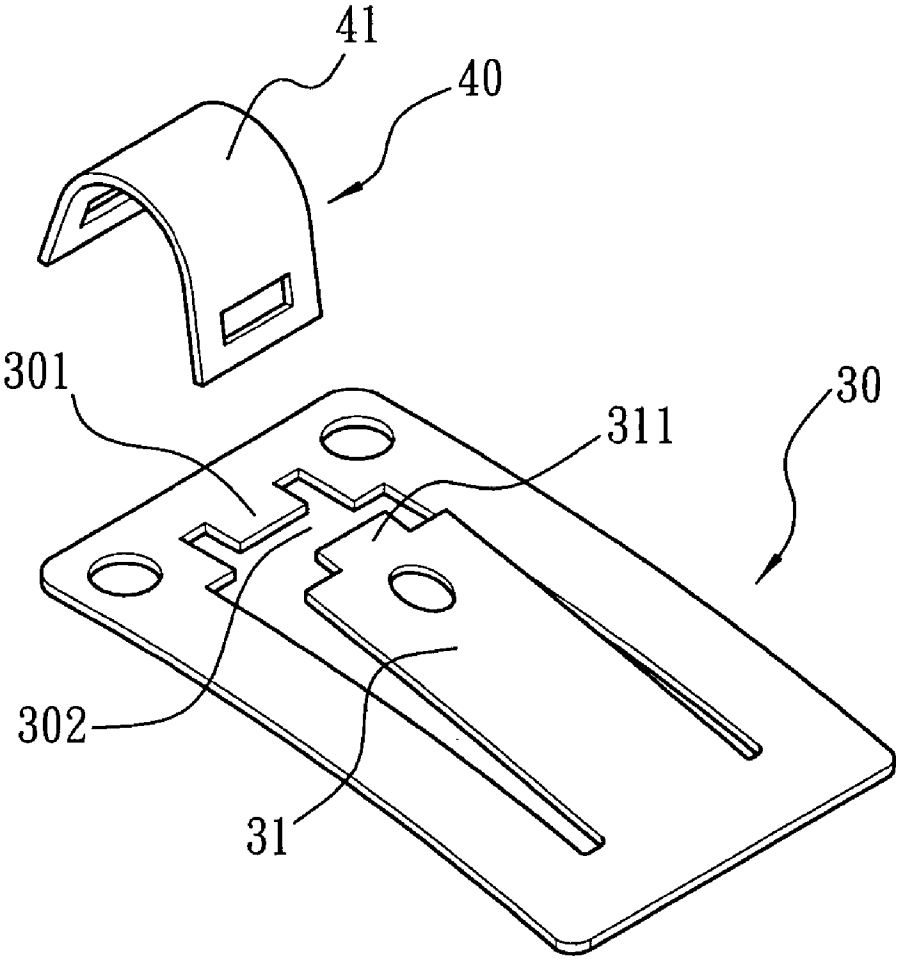
FIG. 3 is a perspective view of a metal strip and a C-shaped plate spring in the first embodiment in the present invention; and, FIG. 4 is a cross-sectional view of a second embodiment of a circuit breaker in the present invention.

A first embodiment of a circuit breaker in the present invention, as shown in FIGS. 1, 2 and 3, includes a movable press strip 10, a hollow shell 20, a metal strip 30, a C-shaped plate spring 40, and a diode 50 as main components combined together.

The movable press strip 10 positioned in an upper portion of the shell 20 is provided with a pivot 101, extending horizontally and transversely in a lower center portion of the interior of the shell 20, a first press member 12 formed in a right end and extending down, a second press member 13 formed in a left portion and extending down. The pivot 101 is combined with the shell 20, and the front end of the press strip 10 with the first press member 12 faces the right vertical wall of the shell 20 and the rear end provided with the second press member 13 positioned near the left wall of the shell 20. Then the press strip 10 can seesaw with the pivot 101, and when the first press member 12 is pressed down, the second press member 13 moves up instead with the pivot 101 as a fulcrum, cutting OFF the circuit breaker, as shown in FIG. 1. On the contrary, when the second press member 13 is pressed down, the first press member is moved up instead, resetting the circuit breaker to let the current get through, as shown in FIG. 2.

The shell 20 is shaped like a case with an open upper side, having a upper projecting edge 204 respectively in two opposite (the front and the rear) sides as shown in FIGS. 1 and 2, limiting the upward movement of the two ends of the press strip 10, and also preventing the two ends with the first and the second press members 12 and 13 from being accidentally pressed, preventing the circuit breaker from being burned up by excessive current larger than the preset load, after the circuit breaker has been cut off.

The shell 20 is provided with a first hole 201, a second hole 202 and a third hole 203 spaced apart in its bottom wall, and an L-shaped conductor 21 is inserted through the first hole 201, with its lower end exposing down out of the bottom wall of the shell 20, and with the upper end portion lying horizontally in the interior of the shell 20. The upper end portion has a first contact point 211 near its tip.

A third conductor 23 is inserted through the third hole 203, having its upper portion positioned in the interior of the shell 20 and the lower portion exposing down out of the bottom of the shell 20.

Further, a double L-shaped conductor 22 is inserted through the second hole 202, with a lower end exposing down out of the bottom wall of the shell 20 in the same way as the first conductor 21, and with the upper end extending upward in the interior of the shell 20. The upper end fits in the left end of the metal strip 30, which has its right end facing under the first press member 12 as shown in FIGS. 1, and 2. The metal strip 30 further has an elastic contact strip 31 as shown in FIG. 3, with a left end of the elastic contact strip 31 facing an inner edge of a projection 301 formed in the left end separated by an opening 302 between them. Further, the elastic contact strip 31 is curved downward, with its free (left) end 311 provided with a second contact point 312 facing on the first contact point 211.

The C-shaped plate spring 40 is shaped nearly like a semicircle, having two ends respectively fitting in the projection 301 of the metal strip 30 and the free end portion 311 of the elastic contact chip 31, as shown in FIGS. 1, 2 and 3. The distance between the two ends of the C-shaped plate spring 40 is longer than the width of the opening 302 in the metal strip 30, with the curved portion 41 of the C-shaped plate spring 40 just faces under the second press member 13 of the press strip 10. So when the second press member 13 is pressed down to move down the curved portion 41, the free end portion 311 with the second contact point 312 of the elastic contact chip 31 may curve down to contact the first contact point 211 to let the circuit breaker tuned ON, as shown in FIG. 2. When an excessively larger current than the preset load should flow through the circuit breaker, the elastic contact chip 31 may be heated up to disfigure, forcing the free end portion 311 and the C-shaped plate spring 40 swell up and also move up the second contact point 312, which then snaps off the first contact point 211, shutting OFF the circuit breaker, and at the same time, the curved portion 41 of the C-shaped plate spring 40 may push up the second press member 13.

Next, the diode 50 is positioned in a rear upper portion of the interior of the shell 20, having first conductive feet 51 and a second conductive foot 52. The first conductive foot 51 extends down from the rear end of he diode 50, having its lower end connected with the upper end of the third conductor 23 fitted through in the third hole 203 of the shell 20. The second conductive feet 52 also extend down from the rear end of the diode 50, contacting the upper end of the second conductor 22. Further, the diode 50 is so located in the movable press strip 10 that the diode 50 can be energized to emit light with the two conductive foot 51 and 52 owing to the ON condition of the circuit breaker.

Figure 4:
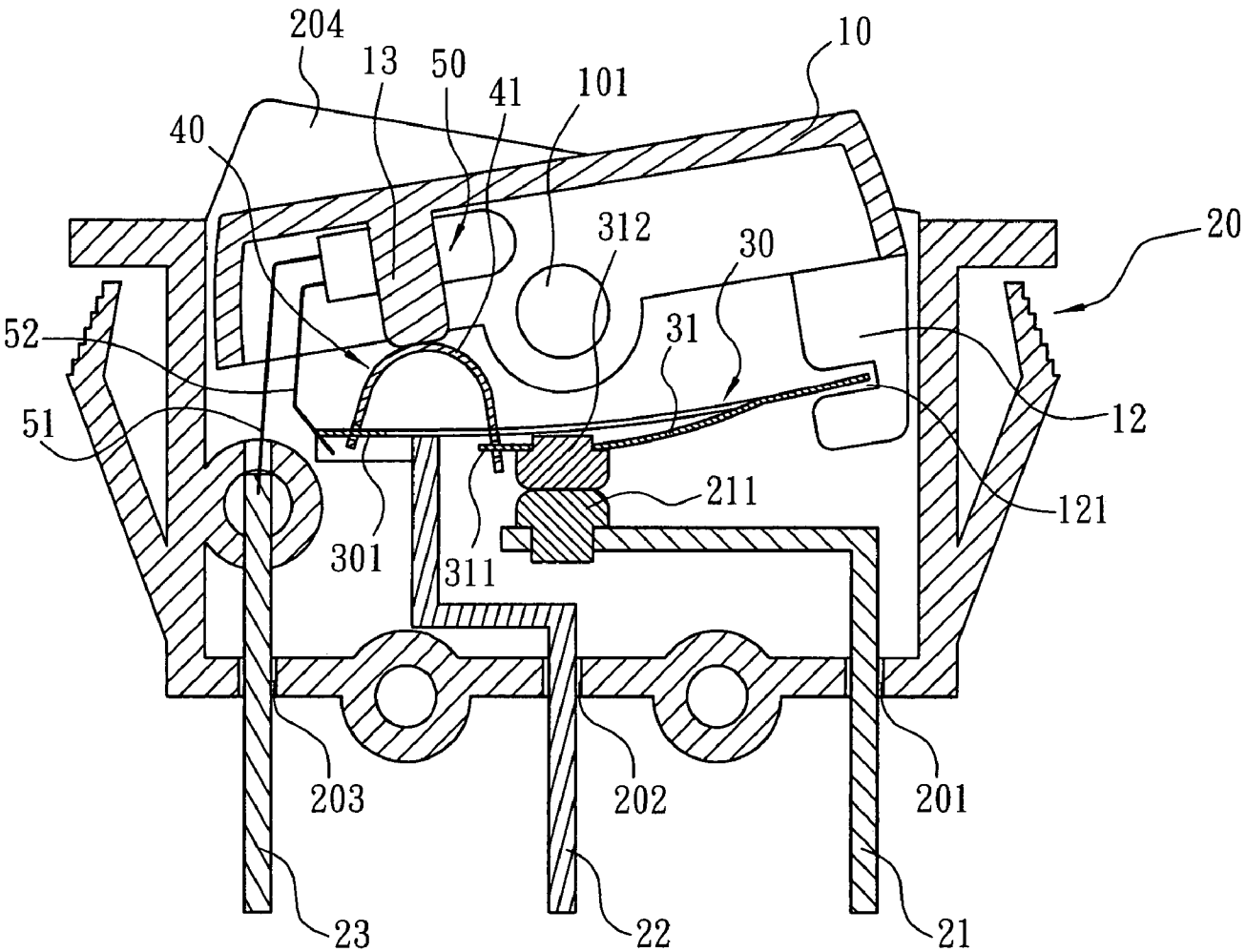

Next, FIG. 4 shows a second embodiment of a circuit breaker, having the same structure as the first embodiment, except that the first press member 12 of the movable press strip 10 is further provided with an inward groove 121 for the right end of the metal strip 30 to extend therein. So when the first press member 12 is pressed down, the right end of the metal strip 30 is also pressed down at the same time so that the second contact point 312 of the metal strip 31 may be lifted up, snapping off the first contact point 211, turning OFF the circuit breaker.

On the contrary, when the second press member 13 is pressed down, the first press member 12 is to be lifted up owing to the function of the pivot 101, and pushes down the left end of the metal strip 30 to force down the second contact point 312 to contact the first contact point 211 , turning ON the circuit breaker. Therefore, the circuit breaker will be turned OFF again if an excessive large current surpassing the present load occurs, repeating the same process already described above.

As can be understood from the aforesaid description, the circuit breaker according to the invention has one advantage in that it can be operated by a user to turn ON or OFF, no matter whether the circuit breaker may be in ON or OFF condition. Another advantage is that the two opposite projecting edges 204 of the shell 20 are able to prevent either end of the movable press strip 10 from accidentally pressed to cause potential danger. Further, a third advantage is the compactness of its size.

While the preferred embodiments of the invention have been described above, it will be recognized and understood that various modifications may be made therein and the appended claims are intended to cover all such modifications that may fall within the spirit and scope of the invention.

What is claimed is:

1. A circuit breaker comprising:

a hollow shell provided with a first hole and a second hole spaced apart in a bottom wall;

a movable press strip provided with a pivot in a lower center portion, said pivot being fixed in an upper portion of said shell, said movable press strip having a right side and a left side located in an interior of said shell, said right side formed with a first press member extending down and said left side formed with a second press member extending down, said first press member and said second press member capable of being pressed down manually with said pivot functioning as a fulcrum to permit said movable press strip to function like a seesaw, wherein said first press member is moved up when said second press member is pressed down, and said second press member is moved up when said first press member is pressed down;

a first conductor inserted through in said first hole of said shell, shaped as an inverted L-shape and having a lower end exposing down out of said shell and an upper end extending in an interior of said shell, a first contact point provided at an upper end of said first conductor;

a second conductor inserted through in said second hole of said shell, shaped as a double L-shape and having a lower end exposed down out of said shell and an upper end extending in the interior of said shell;

a metal strip having a left end connected vertically with the upper end of said second conductor and a right end facing a lower end of said first press member, said metal strip having an elastic contact strip formed integral in its center portion, said elastic contact strip having its right end connected with the body of said metal strip and its left end being free separated from said metal strip, an opening formed between said left end of said elastic contact strip and an inner edge of the left end of said metal strip, said elastic contact strip forming a curved-down dish shape, a second contact point fitted firmly in the free end of said elastic contact strip to face said first contact point of said first conductor; and a C-shaped plate spring having two lower ends inserted in the free end of said elastic contact strip, said C-shaped plate spring having a curved-up portion facing said second press member.

2. The circuit breaker as claimed in claim 1, wherein said first press member of said movable press strip is provided with an inward groove for receiving the right end of said metal strip, and said elastic contact strip with the second contact point being movable to curl up or down when said first press member is pressed down or lifted up to press down or carry up the right end of said metal strip so that said second contact point may snap off said first contact point or contact with said first contact point to turn OFF or ON said circuit breaker.

3. The circuit breaker as claimed in claim 1, wherein said shell is further provided with a third hole in the bottom wall for a third conductor to insert through, said third conductor has an upper end connected with a lower end of a foot of a diode and a lower end exposed down out of the bottom of said shell, said diode has another foot connected with the left end of said second conductor, said diode is positioned in the interior of said movable press strip so that the diode is lit when said circuit breaker is ON.

4. The circuit breaker as claimed in claim 3, wherein said shell is provided with a projecting edge respectively formed in a front and a rear side so that either said end with the first press member or with the second press member may be limited by said projecting edges, in order to prevent either end of said movable press strip from being accidentally pressed down.

5. The circuit breaker as claimed in claim 4, wherein said C-shaped plate spring has the distance between its two ends being longer than the opening in said metal strip, when the second press member presses down the curve portion of said C-shaped plate spring, the free end of said elastic contact strip with said second contact point may be forced to curve down and contact with said first contact point to turn said circuit breaker ON, said elastic contact strip may be heated up to disfigure and force its free end and said C-shaped plate spring to curve up when current flowing through said circuit breaker becomes excessively larger that the present load, said second contact point is also lifted up accordingly to snap off said first contact point to turn said circuit breaker OFF, and the curved portion of said C-shaped plate spring pushes up said second press member at the same time.

* * * * *